US008011049B2

(12) United States Patent
Lee

(10) Patent No.: US 8,011,049 B2
(45) Date of Patent: Sep. 6, 2011

(54) CONTROL METHOD FOR TIME DISPLAY IN DRUM TYPE WASHER BY SPRAY STEAM

(75) Inventor: Phal Jin Lee, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 852 days.

(21) Appl. No.: 11/667,995

(22) PCT Filed: Apr. 18, 2006

(86) PCT No.: PCT/KR2006/001432

§ 371 (c)(1),
(2), (4) Date: Mar. 7, 2008

(87) PCT Pub. No.: WO2007/004785

PCT Pub. Date: Jan. 11, 2007

(65) Prior Publication Data

US 2008/0250573 A1 Oct. 16, 2008

(30) Foreign Application Priority Data

Jun. 30, 2005 (KR) ..... 10-2005-0057972

(51) Int. Cl.
*D06F 33/02* (2006.01)
*D06B 1/02* (2006.01)

(52) U.S. Cl. ..... 8/149.1; 8/149.3; 8/158

(58) Field of Classification Search ..... 8/149.3, 8/158, 159, 149.1; 68/12.04
See application file for complete search history.

(56) References Cited

U.S. PATENT DOCUMENTS

| | | | | |
|---|---|---|---|---|
| 5,561,880 | A * | 10/1996 | Allen et al. | 8/149.3 |
| 5,723,847 | A | 3/1998 | Böldt | |
| 6,673,121 | B2 * | 1/2004 | Mettlach et al. | 8/149.1 |
| 2003/0000022 | A1 * | 1/2003 | Stone | 8/149.3 |
| 2003/0061841 | A1 | 4/2003 | Nakamura et al. | |
| 2003/0110816 | A1 * | 6/2003 | Chang | 68/53 |
| 2005/0034248 | A1 * | 2/2005 | Oh et al. | 8/149.3 |
| 2005/0034250 | A1 * | 2/2005 | Oh et al. | 8/159 |
| 2005/0044641 | A1 * | 3/2005 | Hyeong | 8/159 |

FOREIGN PATENT DOCUMENTS

| | | | |
|---|---|---|---|
| CN | 1537995 | A | 10/2004 |
| CN | 1580379 | A | 2/2005 |
| DE | 28 06 150 | A1 | 7/1979 |
| DE | 37 15956 | A1 | 12/1988 |
| EP | 1 029 964 | A2 | 7/2000 |
| EP | 1 507 032 | A1 | 2/2005 |
| EP | 1507038 | A1 | 2/2005 |
| GB | 2 043 954 | A | 10/1980 |
| GB | 1 603 827 | A | 12/1981 |
| SU | 1481303 | | 5/1989 |

* cited by examiner

*Primary Examiner* — Joseph L. Perrin

(74) *Attorney, Agent, or Firm* — McKenna Long & Aldridge LLP

(57) ABSTRACT

The present invention relates to a method for controlling a time period display at the steam spray type washing machine with a steam generator for washing laundry by using a high temperature steam, in which a preliminary set time required for display in the steam spray cycle is determined, not only with reference to a set temperature, but also with reference to a laundry amount, to minimize an error between the time displayed and an actual time. According to this, since a difference between the preliminary set time displayed in the steam spray cycle and the actual time reached to the set temperature is small, there will be no error which is liable to make the user misunderstood that the washing machine is out of order, According to this, reliability of the product, and convenience of the user is enhanced.

7 Claims, 3 Drawing Sheets

[Fig. 1]
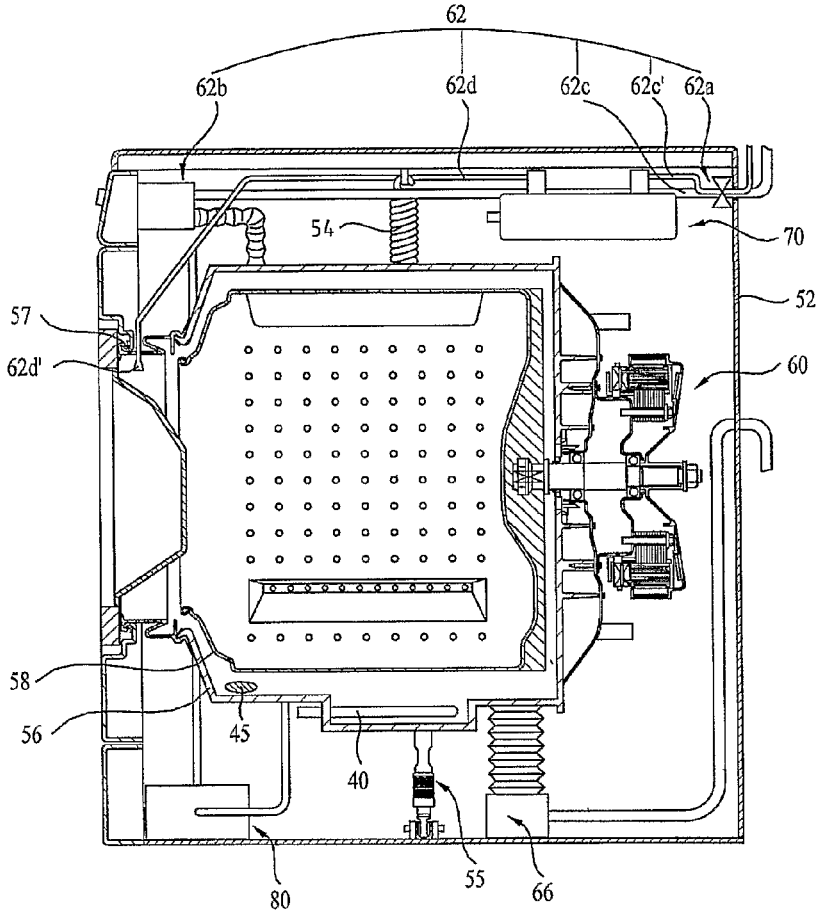
[Fig. 2]
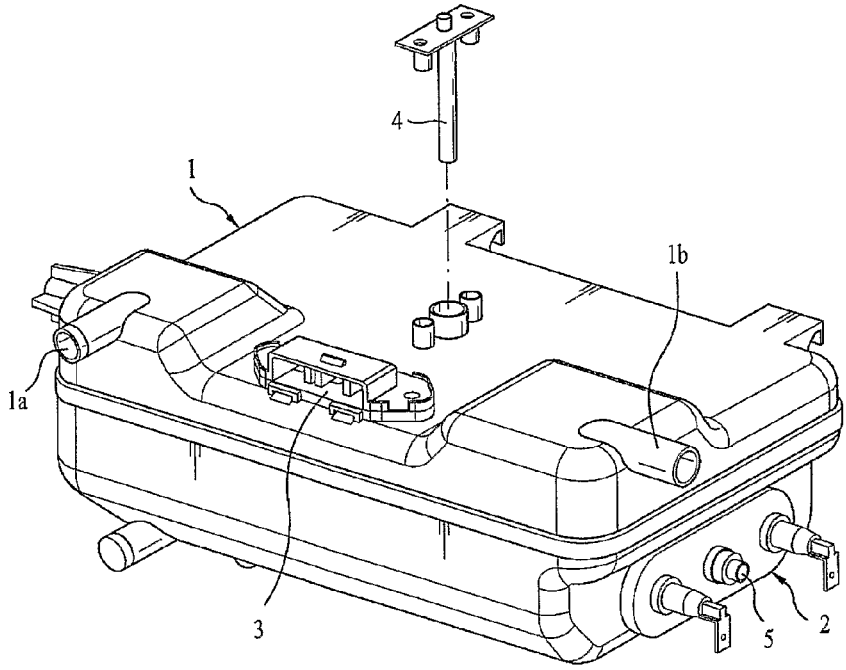

[Fig. 3]
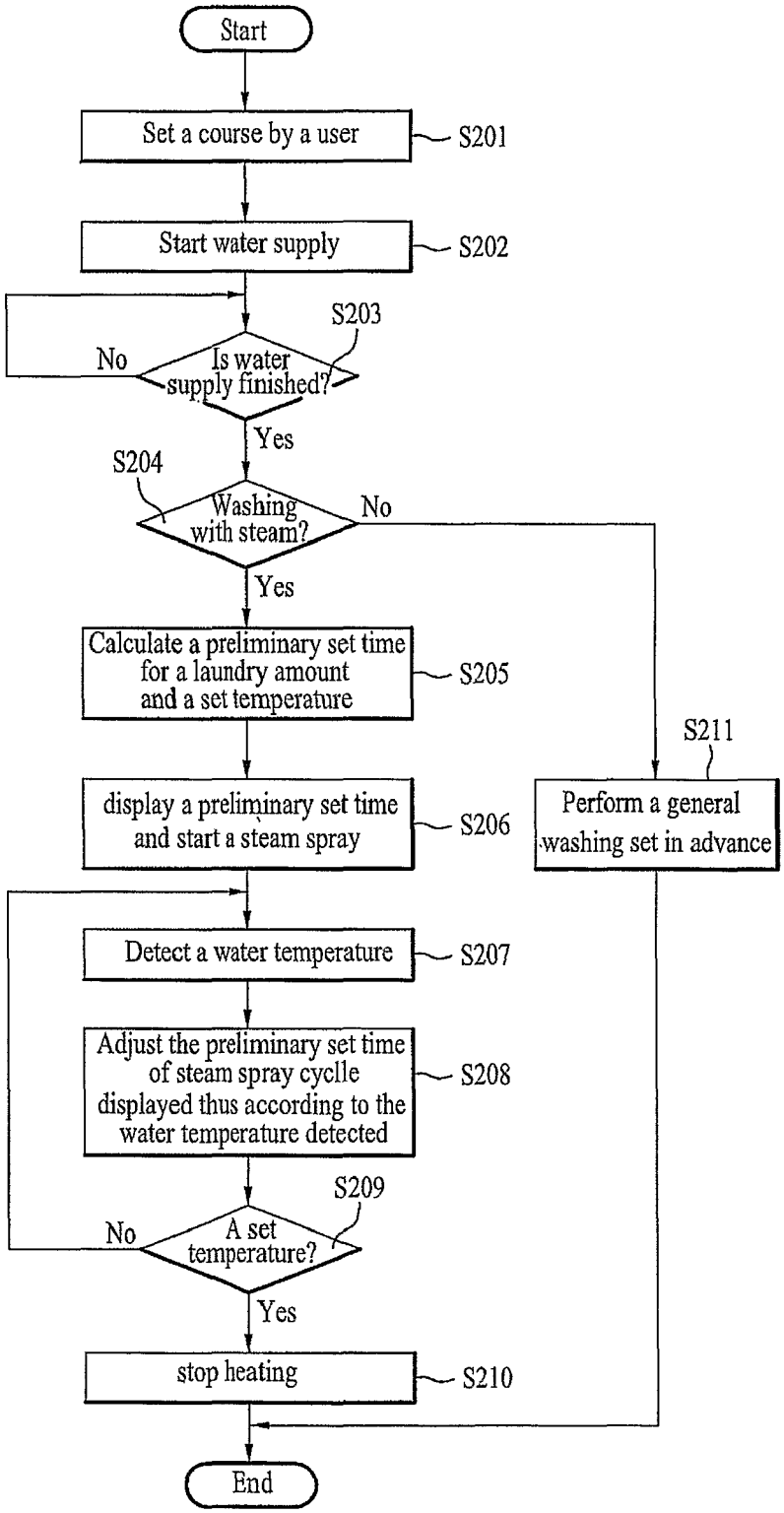

[Fig. 4]
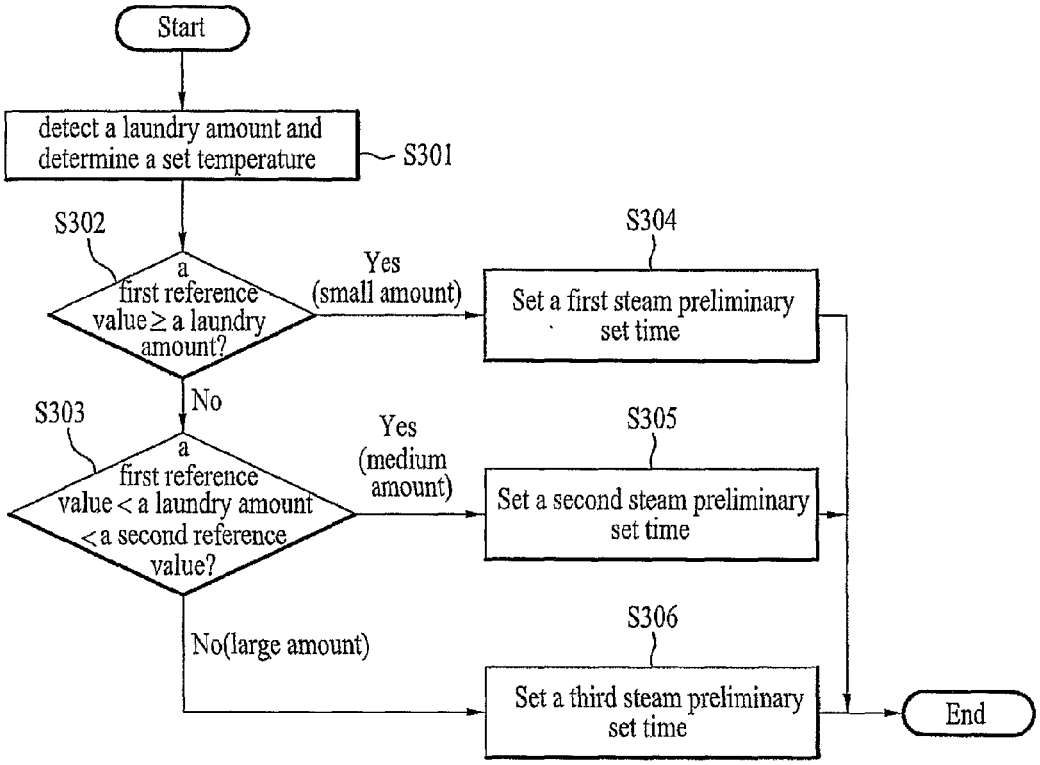

CONTROL METHOD FOR TIME DISPLAY IN DRUM TYPE WASHER BY SPRAY STEAM

This application claims priority to International application No. PCT/KR2006/001432 filed on Apr. 18, 2006, and Korean Application No. 10-2005-0057972 filed on Jun. 30, 2005, all of which are incorporated by reference, as if fully set forth herein.

TECHNICAL FIELD

The present invention relates to washing machines, and more particularly, to a method for controlling a time period display at a steam spray type washing machine with a steam generator for washing laundry with high temperature steam.

BACKGROUND ART

In general, the washing machine, a home appliance used the most generally, removes dirt from laundry, such as clothes and beddings by using a softening action of detergent, friction of a water circulation caused by rotation, and impact of the water to the laundry.

In the washing machines, there are pulsator type washing machines each having an upright drum, and drum type washing machines each having a drum laid down in a horizontal direction.

A washing cycle is a process for removing dirt from the laundry put into the drum together with detergent, and washing water by chemical action of detergent in washing water, and physical action of the drum.

A rinsing cycle is a process for rinsing the detergent and dirt from laundry by supplying washing water containing no detergent, and a spinning cycle is a process for rotating a washing tub at the high speed after finish of the rinsing cycle for extracting water from the laundry.

Because a related art washing machine consumes a large amount of washing water, recently there are efforts for minimizing an amount of the washing water used in the washing.

What has been developed as a result of such an effort is a washing machine with a steam generator, wherein the steam generator assists to progress a highly effective washing with a comparatively small amount of washing water by supplying high temperature steam to the drum.

In general, a function is provided to the user, in which a time required for a cycle is displayed on display means of the washing machine for the user to notice an entire cycle time or a remained cycle time during the washing is in progress.

The cycle time required for a cycle includes not only a time required for washing, rinsing, and spinning, but also a time required for water supply/drainage, and a time of the steam spray. While the time periods of the washing, the rinsing, the spinning are fixed depending on a washing course, the cycle time required for the steam spray varies with environments of application.

In a steam spray cycle, high temperature steam is sprayed to an inside of the drum, for heating washing water in the drum to a temperature higher than a preset temperature. However, in the steam spray cycle, an actual time required for heating the washing water to the preset temperature varies depending on the environment of application of the steam, i.e., a water pressure, use of hot/cold water, and so on.

Due to those reasons, a steam spray cycle time has been set and displayed, preliminarily.

Accordingly, once the steam spray cycle is started, the preliminarily set time is displayed, and the preliminarily set steam spray time is down counted according to a rate of temperature change of washing water heated by the steam sprayed thereto.

However, since an actual required time of the steam spray cycle varies with the environment of application, the preliminarily set time displayed on the display means can not, but shows an error with respect to an actual time taken.

For an example, because the rate of the washing water temperature change is high if a laundry amount is small, an interval of decrement of the down count of the preliminarily set time becomes greater, leading the displayed time to be changed rapidly. Opposite to this, because the rate of the washing water temperature change is low if a laundry amount is great, an interval of decrement of the down count of the preliminarily set time becomes smaller, leading the displayed time to be changed slowly, and if the decrement is small extremely, it can be misunderstood that the display time is standstill, temporarily.

That is, due to the error between the preliminarily set time set arbitrarily and the actual cycle time taken to reach to a preset temperature, the user is liable to misunderstood the rapid change or the temporary standstill of the display time as a fault of the washing machine. Moreover, the difficulty of estimating the required time of the steam spray impairs reliability of the washing machine.

DISCLOSURE OF INVENTION

Technical Problem

An object of the present invention is to provide a method for controlling a time period display at a steam spray type washing machine, in which an error of a preliminarily set steam spray cycle time with respect to an actual time taken can be minimized.

Another object of the present invention is to provide a method for controlling a time period display at a steam spray type washing machine, which can improve reliability of a time display function provided in a steam spray cycle.

Technical Solution

The object of the present invention can be achieved by providing a method for controlling a time period display at a steam spray type washing machine including the steps of (a) determining a preliminary set time of a steam spray cycle according to cycle information of the steam spray cycle, and (b) displaying the preliminary set time determined thus while the steam spray cycle is progressed.

Preferably, the cycle information is a target temperature for heating washing water fixed in the steam spray cycle and a laundry amount at the present time.

The (a) step of determining a preliminary set time includes the step of fixing the preliminary set time for the target temperature for heating the washing water in the present steam spray cycle and the laundry amount by using a preliminary set time table for target temperatures and laundry amounts defined in advance.

The (b) step of displaying the preliminary set time includes the steps of displaying the preliminary set time of the steam spray cycle determined thus, detecting an inside temperature of a drum heated by the steam sprayed thus during the steam spray cycle is progressed, and down-counting the preliminary set time displayed thus in proportion to a rate of change of a washing water temperature detected thus, to display the time varied thus.

Advantageous Effects

The method for controlling a time period display at a steam spray type washing machine of the present invention has the following advantages.

First, the determination of the preliminary set time required for display in the steam spray cycle, not only with reference to a set temperature, but also with reference to a laundry amount enables to minimize an error between the time displayed and an actual time.

Second, since a difference between the preliminary set time displayed in the steam spray cycle and the actual time reached to the set temperature is small, there will be no error which is liable to make the user misunderstood that the washing machine is out of order. According to this, reliability of the product, and convenience of the user is enhanced.

BRIEF DESCRIPTION OF THE DRAWINGS

FIG. 1 illustrates a longitudinal section of a general steam spray, drum type washing machine;

FIG. 2 illustrates a perspective view of the steam generator mounted on the drum type washing machine in FIG. 1;

FIG. 3 illustrates a flow chart of the steps of a method for controlling a steam spray cycle at a steam spray type washing machine in accordance with a preferred embodiment of the present invention; and FIG. 4 illustrates a flow chart of the steps of a method for calculating a preliminary set time for a steam spray cycle in accordance with a preferred embodiment of the present invention.

BEST MODE FOR CARRYING OUT THE INVENTION

Reference will now be made in detail to the preferred embodiments of the present invention, examples of which are illustrated in the accompanying drawings.

A preferred embodiment of a method for controlling a time period display at a steam spray type washing machine in accordance with the present invention will be described with reference to the attached drawings.

FIG. 1 illustrates a longitudinal section of a general steam spray, drum type washing machine, and FIG. 2 illustrates a perspective view of the steam generator mounted on the drum type washing machine in FIG. 1.

A steam spray type washing machine having the present invention applied thereto will be described with reference to FIGS. 1 and 2.

Referring to FIG. 1, the steam spray type washing machine includes a cabinet 52 of an exterior of the washing machine, a tub 56 suspended from an inside of the cabinet 52 by springs 54 and supported on damper assemblies 55, a drum 58 rotatably mounted in the tub for holding washing water and laundry, a motor 60 mounted in rear of the tub 56 connected to the drum 58 for rotating the drum 58, a steam generator 70 on an upper side of the tub 56 for heating washing water to high temperature and high pressure steam and supplying the steam to the drum 58, and a pump unit 80 under the tub 56 for pumping and circulating the washing water in the tub 56.

On a lower side of the tub 56, there are a washing heater 40 for heating the washing water in the tub 56 to a high temperature for improving a washing performance, and a water temperature sensor for sensing a temperature of the washing water circulating the tub 56 and transmitting the temperature to a microcomputer (not shown) for controlling an entire system.

Along with this, the steam spray type washing machine also includes water supply means 62 for supplying washing water to the tub 56 and the drum 58, and water discharge pump assembly 66 for discharging the washing water from the tub 56 and the drum 58. The steam generator 70 is connected to the water supply means 62.

The water supply means 62 includes a water supply valve assembly 62*a* for controlling water supply to the drum 58, a detergent box assembly 62*b* connected, between the water supply valve assembly 62*a* and the tub 56 for holding detergent, first and second water supply flow lines 62*c* and 62*c*' connected to the detergent box assembly 62*b* and the steam generator 70 from the water supply valve assembly 62*a* respectively, and a steam flow line 62*d* having one end connected to the steam generator 70 and the other end positioned in the tub 56 and the drum 58, for supplying steam to the tub 56 and the drum 58.

The steam flow line 62*d* has a nozzle shaped end 62*d*' passed through a gasket 57 connected between the tub 56 and the cabinet 52 and positioned in the tub 56 and the drum 58 for high speed spray of the steam.

Particularly, referring to FIG. 2, the steam generator 70 includes a case 1, a steam heater 2, a water level sensor 3, a temperature sensor 4, and a thermo-fuse 5.

The case 1 is an exterior of the steam generator 70 and forms a water holding space required for generation of steam.

The case 1 has a water supply pipe 1*a* at one side connected to the second water supply flow line 62*c*' and a steam discharge pipe 1*b* at the other side connected to the steam flow line 62*d* for supplying the steam from the case to the drum 58.

The steam heater 2 is mounted in a lower side space of the case 1 in a horizontal direction for heating water held in the case 1 for generation of steam.

The water level sensor 3, and the temperature sensor 4 are mounted passed through one side of an upper surface of the case 1. The water level sensor senses a water level in the case 1, and the temperature sensor 4 senses a temperature of an inside of the case 1.

The thermo-fuse 5 is provided at a terminal of the steam heater 2 for cutting off power to the steam heater 2 in a case the steam heater 2 is overheated.

According to this system, if the steam generator 70 is put into operation, the water supply valve assembly 62*a* is opened, to supply washing water to the water holding space in the case 1 through the second water supply flow line 62*c*'.

If the water is supplied to the steam generator 70 up to a preset water level, the water supply valve assembly 62*a* is cut off and, at the same time with this, the steam heater 2 generates heat.

The heat of the steam heater 2 heats the washing water supplied to the case 1 to generate steam, and the steam is guided along the steam flow line 62*d*, and sprayed to the tub 56 and the drum 58.

The steam spray by using the steam generator 70 is an additional function in the washing.

A method for controlling a time period display at a steam spray type washing machine will be described in detail, talking the foregoing steam spray type washing machine as an example.

FIG. 3 illustrates a flow chart of the steps of a method for controlling a steam spray cycle at a steam spray type washing machine in accordance with a preferred embodiment of the present invention, and FIG. 4 illustrates a flow chart of the steps of a method for calculating a preliminary set time for a steam spray cycle in accordance with a preferred embodiment of the present invention.

The present invention suggests calculating a preliminary set time required to be displayed during a steam spray cycle, taking a laundry amount together with a set temperature, for minimizing an error between the preliminary set time to be displayed and the actual steam spray cycle time.

Referring to FIG. 3, the user selects and inputs a desired washing course, and if the washing course the user selects includes the steam spray cycle, the user also inputs a set temperature which is a temperature up to which the washing water to be heated (S201).

If user's input is finished, and the user inputs a cycle start order, water is supplied to the drum 58 and the steam generator 70 (S202).

If a water level of the steam generator 70 reaches to a preset level, the water supply to the steam generator 70 is stopped, and, if a water level of the drum 58 reaches to a preset level, the water supply to the drum 58 is also stopped.

If the water supply to the drum 58 is stopped (S203), it is determined whether the washing course the user selects is a washing course that includes the steam spray cycle or not (S204).

As a result of the determination (S204), if the washing course the user selects is a washing course that does not include the steam spray cycle, the cycle selected by the user is performed according to an algorithm required for the washing course the user selects (S211).

On the other hand, as a result of the determination (S204), if the washing course the user selects is a washing course that includes the steam spray cycle, a preliminary set time is determined for the steam spray cycle with reference to an mount of laundry in the drum presently together with the set temperature received in above step S201 (S205).

It is preferable that a table of preliminary set times is provided for various laundry amounts and set time periods in advance through an experiment in which an actual cycle time required for reaching to a particular set temperature for a particular laundry amount in the steam spray cycle is found out by repeating experiments in which the steam spray cycle is performed while varying the laundry amount and the set temperature in a production process.

The preliminary set time can be fixed for the steam spray cycle for the laundry amount in the drum presently and the set temperature the user inputted by using the preliminary set time table.

If the preliminary set time is fixed for the set temperature and the laundry amount in above step S205, the preliminary set time is displayed on display means of the washing machine, and the steam spray is started (S206).

Then, a water temperature in the drum 58 is detected periodically during the steam spray (S207), to down-count and vary the preliminary set time displayed according to a rate of change of the water temperature detected thus (S208).

Thus, the steam spray cycle is performed while adjusting the preliminary set time displayed thus, and if the washing water temperature reaches to the set temperature by the steam spray (S209), the steam spray is stopped (S210).

Thus, by providing the preliminary set time table for the laundry amounts and the set temperatures, the present invention can minimized an error between the preliminary set time and the actual cycle time in the steam spray cycle.

That is, the smaller the error between the preliminary set time and the actual cycle time, the time displayed and the actual cycle time are become the more consistent, to make a decrement of adjustment of the time display as the time goes by to be comparatively constant.

The method for controlling a time period display at a steam spray type washing machine of the present invention enables to reduce the error between the preliminary set time and the actual cycle time in the steam spray by fixing the preliminary set time, not only with reference to the set temperature, but also with reference to the laundry amount.

In fixing the preliminary set time with reference to the laundry amount in the preferred embodiment of the present invention, even though the laundry amount is classed in three stages of small, medium, and large as an example, if the laundry amount is classed in more detail, a more accurate preliminary set time can be fixed.

Though it is a prerequisite that the set temperatures are the same in the embodiment described below, it is preferable that the set temperature is divided into a plurality of levels in providing the preliminary set time table for the laundry amounts for each of the temperature levels.

An example of a process for setting the preliminary set time for the steam spray cycle of the present invention will be described.

FIG. 4 illustrates a flow chart of the steps of a method for calculating a preliminary set time for a steam spray cycle in accordance with a preferred embodiment of the present invention.

At first, a present laundry amount in the drum 58 is detected, and the following process is progressed with reference to the detected laundry amount and a set temperature the user inputted, to fix the preliminary set time (S301).

Ink the following description, the first and second reference values meet a condition of the first reference value<the second reference value, and first, second, and third preliminary set times meet a condition of the first preliminary set time<the second preliminary set time<the third preliminary set time.

A laundry amount is compared to the first reference value, to determine if the present laundry amount is smaller or the same with the first reference value (S302).

If the present laundry amount is smaller or the same with the first reference value, it is determined that the present laundry amount is small, to fix the preliminary set time of the steam spray cycle to be the first preliminary set time (S304).

If the present laundry amount is greater than the first reference value, it is determined if the present laundry amount is greater than the first reference value and smaller than the second reference value (S303).

If the present laundry amount meets a condition of the first reference value<the laundry amount<the second reference value, the present laundry amount is determined to be medium, to fix the preliminary set time to be the second preliminary set time (S305).

If the present laundry amount is greater than the second reference value, such that the present laundry amount does not fall within a range of the first reference value<the laundry amount<the second reference value, the present laundry amount is determined to be a large amount, to fix the preliminary set time to be the third preliminary set time (S306).

In this instance, the first, second, and third preliminary set times vary not only with the set temperature, but also with the laundry amount. By dividing the set temperature and the laundry amount into smaller scales, the time displayed (the preliminary set time) and the actual cycle time can be made more consistent.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A controlling method of a washing machine, comprising:

determining a preliminary set time of a steam spray cycle according to information associated with the cycle; and varying the preliminary set time according to a detected rate of temperature change of washing water in a tub, wherein the information further includes a set temperature of washing water in the tub.

2. The controlling method as claimed in claim 1, further comprising:

displaying the preliminary set time.

3. The controlling method as claimed in claim 2, further comprising:

decreasing the preliminary set time while the steam spray cycle is in progress.

4. The controlling method as claimed in claim 1, wherein the preliminary set time is determined by reading from a data table.

5. The controlling method as claimed in claim 1, wherein the information includes an amount of laundry inside a drum.

6. The controlling method as claimed in claim 1, further comprising:

detecting an amount of laundry in a drum and classifying the detected amount of laundry to use in determining the preliminary set time.

7. The controlling method as claimed in claim 1, wherein the set temperature is input by a user.

* * * * *